US011802028B2

(12) United States Patent
Henkel

(10) Patent No.: US 11,802,028 B2
(45) Date of Patent: Oct. 31, 2023

(54) TELESCOPIC BOOM FOR A CRANE AND CRANE HAVING A CORRESPONDING TELESCOPIC BOOM

(71) Applicant: Liebherr-Werk Ehingen GmbH, Ehingen (DE)

(72) Inventor: Joachim Henkel, Holzgünz (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 0 days.

(21) Appl. No.: 17/649,311

(22) Filed: Jan. 28, 2022

(65) Prior Publication Data

US 2022/0227607 A1 Jul. 21, 2022

Related U.S. Application Data

(62) Division of application No. 16/200,406, filed on Nov. 26, 2018, now abandoned.

(30) Foreign Application Priority Data

Nov. 27, 2017 (DE) ..... 10 2017 127 973.3

(51) Int. Cl.
*B66C 23/70* (2006.01)

(52) U.S. Cl.
CPC ..... *B66C 23/701* (2013.01)

(58) Field of Classification Search
CPC ... B66C 23/701; B66C 23/702; B66C 23/703; B66C 23/705; B66C 23/706; B66C 23/707; B66C 23/708
See application file for complete search history.

(56) References Cited

U.S. PATENT DOCUMENTS

| | | | |
|---|---|---|---|
| 3,419,157 | A | 12/1968 | Brady |
| 3,620,579 | A | 11/1971 | Brown et al. |
| 3,721,054 | A | 3/1973 | Hornagold |
| 3,736,710 | A | 6/1973 | Sterner |
| 3,804,262 | A | 4/1974 | Wiencek et al. |
| 3,807,108 | A | 4/1974 | Johnston |
| 4,045,936 | A | 9/1977 | Sterner |
| 4,098,172 | A | 7/1978 | Wright et al. |
| 4,133,411 | A | 1/1979 | Curb |
| 4,166,542 | A | 9/1979 | Bryan, Jr. |
| 4,168,008 | A | 9/1979 | Granryd |

(Continued)

FOREIGN PATENT DOCUMENTS

| | | | |
|---|---|---|---|
| DE | 2205093 | A1 | 8/1973 |
| DE | 202014004976 | U1 | 8/2014 |

(Continued)

OTHER PUBLICATIONS

DE 202014004976 U1 Machine Translation. (Year: 2014).*

*Primary Examiner* — Michael R Mansen
*Assistant Examiner* — Juan J Campos, Jr.
(74) *Attorney, Agent, or Firm* — McCoy Russell LLP

(57) ABSTRACT

The present disclosure relates to a telescopic boom for a crane, wherein the telescopic sections of the telescopic boom each comprise at least one main telescopic part and at least one additional telescopic part and wherein the main telescopic part and the additional telescopic part are arranged above one another. The disclosure further relates to a crane having a corresponding telescopic boom.

18 Claims, 14 Drawing Sheets

(56) References Cited

U.S. PATENT DOCUMENTS

| | | | | |
|---|---|---|---|---|
| 5,865,328 | A * | 2/1999 | Kaspar | B66C 23/707 212/230 |
| 6,098,824 | A * | 8/2000 | Krebs | B66C 23/701 52/118 |
| 6,499,612 | B1 * | 12/2002 | Harrgington | B66C 23/701 212/270 |
| 6,516,962 | B1 * | 2/2003 | Irsch | B66C 23/701 212/347 |
| 6,586,084 | B1 * | 7/2003 | Paschke | B66C 23/701 442/232 |
| 2003/0071005 | A1 | 4/2003 | Higgins | |
| 2014/0083968 | A1 * | 3/2014 | Kobayashi | B66C 23/701 212/348 |
| 2014/0158657 | A1 | 6/2014 | Knecht et al. | |

FOREIGN PATENT DOCUMENTS

| | | | | |
|---|---|---|---|---|
| DE | 202014004976 | U1 * | 9/2014 | B66C 23/701 |
| DE | 102015007064 | A1 | 12/2015 | |

* cited by examiner

TELESCOPIC BOOM FOR A CRANE AND CRANE HAVING A CORRESPONDING TELESCOPIC BOOM

CROSS-REFERENCE TO RELATED APPLICATIONS

The present application is a divisional of U.S. Non-Provisional patent application Ser. No. 16/200,406, entitled "TELESCOPIC BOOM FOR A CRANE AND CRANE HAVING A CORRESPONDING TELESCOPIC BOOM", and filed on Nov. 26, 2018. U.S. Non-Provisional patent application Ser. No. 16/200,406 claims priority to German Patent Application No. 10 2017 127 973.3, entitled "TELESKOPAUSLEGER FÜR EINEN KRAN UND KRAN MIT EINEM ENTSPRECHENDEN TELESKOPAUSLEGER" filed Nov. 27, 2017. The entire contents of the above-listed applications are hereby incorporated by reference for all purposes.

TECHNICAL FIELD

The present disclosure relates to a telescopic boom for a crane, wherein the telescopic sections of the telescopic boom each comprise at least one main telescopic part and at least one additional telescopic part and wherein the main telescopic part and the additional telescopic part are arranged above one another. The disclosure further relates to a crane having a corresponding telescopic boom.

BACKGROUND AND SUMMARY

Telescopic boom cranes having telescopic booms, that can be designed as mobile cranes for example, are known from the prior art. Road traffic licensing legislation regulates the dimensions of such mobile cranes that may accordingly drive on public roads.

To obtain a road traffic license suitable in practice, a space above the road of up to 3 m in width and 4 m in height can be used. All the required components of the crane have to be accommodated within this space. The freedom of movement, that is, the movements that can be carried out by the respective components, needs to be taken into account here. As one of the largest components, telescopic booms have to be taken into special consideration. Collisions between the components themselves or between the components and objects located in the vicinity of the crane may not occur at any time. This applies both to road travel of the crane and to crane operation.

Against this background, it is the object of the present disclosure to provide a telescopic boom and a crane that make the best possible use of the available space and that simultaneously ensure a load carrying capacity of the crane or of the telescopic boom that is as high as possible. It naturally simultaneously has to be ensured here that the aforesaid collisions of the components do not occur at any time.

This object is achieved in accordance with the disclosure by a telescopic boom for a crane, wherein telescopic sections of the telescopic boom each comprise at least one main telescopic part and at least one additional telescopic part, wherein the main telescopic part and the additional telescopic part are arranged above one another, wherein the main telescopic part and the additional telescopic part bound two mutually separate hollow spaces or bound one common hollow space; and/or in that the additional telescopic part is wider than the main telescopic part.

A telescopic boom for a crane is accordingly provided, wherein the telescopic sections of the telescopic boom each comprise at least one main telescopic part and at least one additional telescopic part and wherein the main telescopic part and the additional telescopic part are arranged above one another. Provision is made in accordance with the disclosure that the main telescopic part and the additional telescopic part bound two mutually separate hollow spaces or bound one common hollow space and/or that the additional telescopic part is wider than the main telescopic part.

The telescopic boom can accordingly comprise telescopic sections having two main parts, the main telescopic part and the additional telescopic part, that are either each formed as elongate hollow profiles and thus bound and define two hollow spaces separate from one another. Or the telescopic boom can comprise telescopic sections in which the main telescopic part and the additional telescopic part can be different portions of a single, contiguous hollow profile that bound a common hollow space. Said hollow spaces relate to the interior of the telescopic parts and extend, as is known, in the longitudinal direction of the telescopic sections.

Provision can furthermore be made that the additional telescopic part, that is in particular arranged above the main telescopic part, is wider than the main telescopic part. The narrower main telescopic part thus offers more space at the side for further devices of the telescopic boom or of the corresponding crane. The wider additional telescopic part can be arranged above said devices of the telescopic boom or of the crane. Greater forces and torques can be borne by this portion of the telescopic boom due to the wider design of the additional telescopic part.

In an example embodiment of the disclosure, it is conceivable that the telescopic sections are configured to bolt an inner main telescopic part to an outer main telescopic part from the inside and to bolt an inner additional telescopic part to an outer additional telescopic part from the outside. The inner and outer telescopic parts in the present case relate to telescopic parts of telescopic sections directly adjacent to one another.

It is conceivable in an alternative embodiment that the telescopic sections are configured to bolt an inner main telescopic part to an outer main telescopic part from the inside and to bolt an inner additional telescopic part to an outer additional telescopic part from the inside.

It is conceivable in a further alternative embodiment that the telescopic sections are configured to bolt an inner main telescopic part to an outer main telescopic part from the outside and to bolt an inner additional telescopic part to an outer additional telescopic part from the outside.

Depending on the design or geometry of the telescopic boom, a corresponding bolt connection can thus be provided, with the directly adjacent telescopic sections being able to be bolted from the outside or from the inside depending on the design solution.

It is conceivable in a further alternative embodiment that the outermost main telescopic part and the outermost additional telescopic part are connected to one another with shear rigidity at their ends. The term of the ends can here relate to the two axially outermost regions of the outermost telescopic parts. The connection with shear rigidity can, for example, comprise welded or screwed connection portions between said telescopic parts.

It is conceivable in a further alternative embodiment that a main telescopic part is connected with shear rigidity to the respective additional telescopic part at one of their ends. The two telescopic parts connected in this manner here form two parts of a single telescopic boom section or telescopic section and their connection with shear rigidity advantageously stabilizes the telescopic boom.

It is conceivable in a further alternative embodiment that bearing elements are provided between the telescopic sections. The bearing elements can be arranged at different points of the telescopic sections and serve to transmit forces between the individual telescopic sections and to support the telescopic sections with low friction and low wear on their retraction and extension.

It is conceivable in a further alternative embodiment that a portion of the telescopic sections that is central in the vertical direction is concave when observed from the outside. The vertical direction of the telescopic section here designates the vertical extent of the cross-sectional profile of the telescopic section in a stored state of the telescopic section. A central section thereof is correspondingly present between the upper and lower edges of the telescopic section or of the cross-section of the telescopic section. The concave portion can here comprise any desired inwardly bent and/or edged profile line.

It is conceivable in a further alternative embodiment of the disclosure that a portion of the telescopic sections that is central in the vertical direction extends, observed in cross-section, at least portion-wise in parallel with an upper and/or lower portion of the telescopic sections. It is in particular conceivable that the central portion extends horizontally or substantially portion-wise horizontally in the stored state of the telescopic section. A mushroom-shaped or T-shaped cross-sectional view or cross-sectional form of the telescopic section can hereby result.

In accordance with a further embodiment of the disclosure, a portion of the telescopic sections at the top in the vertical direction can be convex in cross-section viewed from the outside. The convex design reinforces this portion against warpage.

The disclosure is further directed to a crane having a telescopic boom, wherein telescopic sections of the telescopic boom each comprise at least one main telescopic part and at least one additional telescopic part, wherein the main telescopic part and the additional telescopic part are arranged above one another, wherein the main telescopic part and the additional telescopic part bound two mutually separate hollow spaces or bound one common hollow space; and/or in that the additional telescopic part is wider than the main telescopic part. At least one device, e.g., support pillars, load-bearing structural steelwork of the slewing platform, luffing rams, of the crane is arranged to the side of the main telescopic part in the crane in accordance with the disclosure.

BRIEF DESCRIPTION OF THE DRAWINGS

Further details and advantages result from the embodiments shown by way of example in the Figures. There are shown.

DETAILED DESCRIPTION

Figure 1:
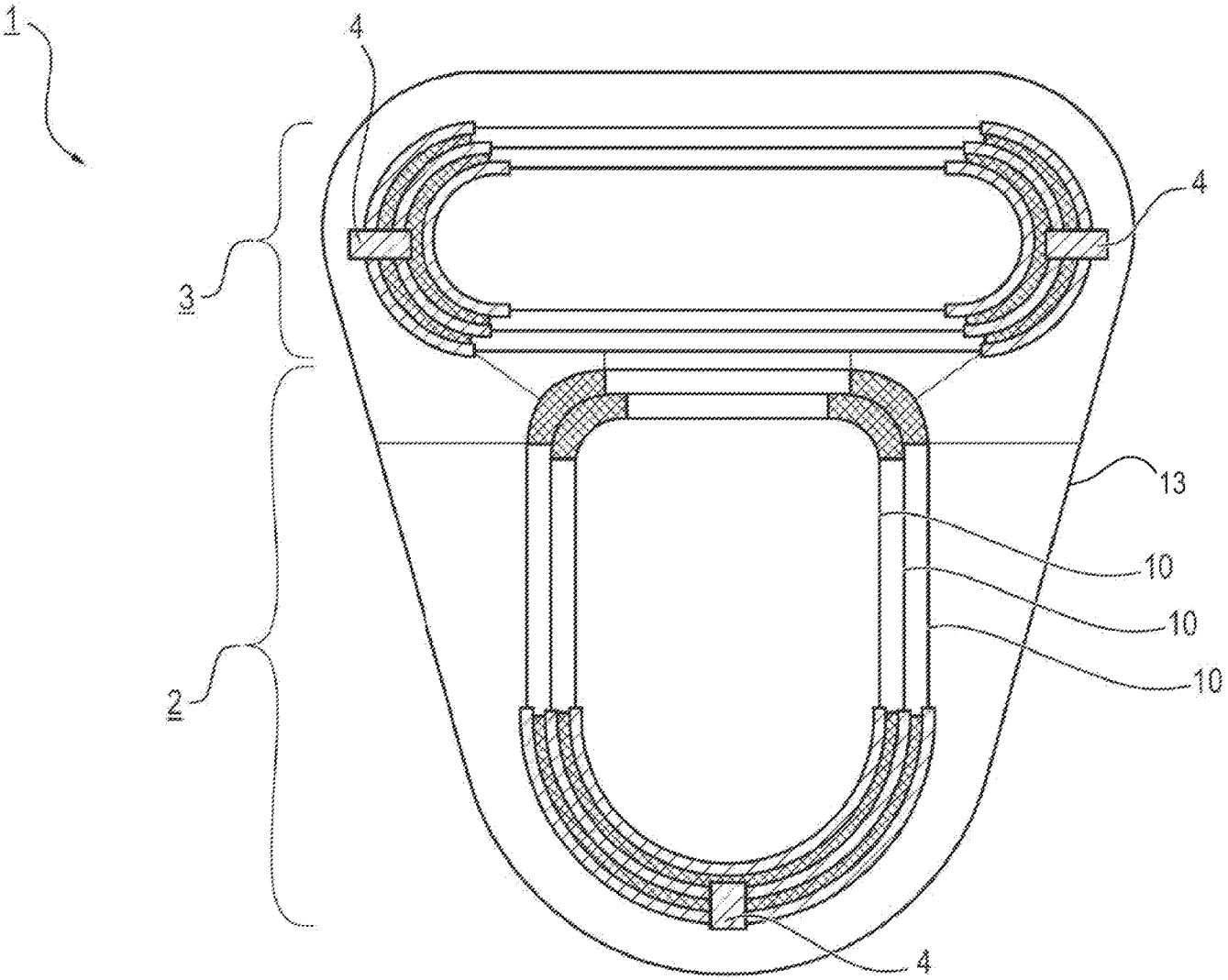
FIG. 1 shows a cross-sectional view of a first embodiment of the telescopic boom.

FIG. 1 schematically shows a telescopic boom 1 for a crane. Three telescopic sections supported in one another can be recognized. Each telescopic section comprises a main telescopic part 2 and an additional telescopic part 3. The two telescopic parts 2, 3 are arranged above one another.

In the first embodiment of the disclosure shown in FIG. 1, the two telescopic parts 2, 3 bound two hollow spaces separate from one another. The separation takes place here at least partly through the walls of the telescopic parts 2, 3. The additional telescopic part 3 of each telescopic section 10 is wider than the corresponding main telescopic part 2 of the same telescopic section 10.

The total boom 1 thus comprises a main telescopic boom comprising the main telescopic parts 2 and an additional telescopic boom comprising the additional telescopic parts 3. An additional telescopic part 3 is connected at at least one end via a design with shear rigidity to the respective main telescopic part 2.

The two largest base bodies of the main telescopic boom and the additional telescopic boom or the largest main telescopic part 2 and the largest additional telescopic part 3 are connected to one another at their two ends via a design with shear rigidity.

The main telescopic parts 2 are latched to one another by a mechanical bolting unit. The additional telescopic parts 3 are mechanically connected to one another by two respective bolting units, arranged laterally. The bolts used are marked by the reference numeral 4.

Three variants of the bolt connection are contemplated.

Figure 2:
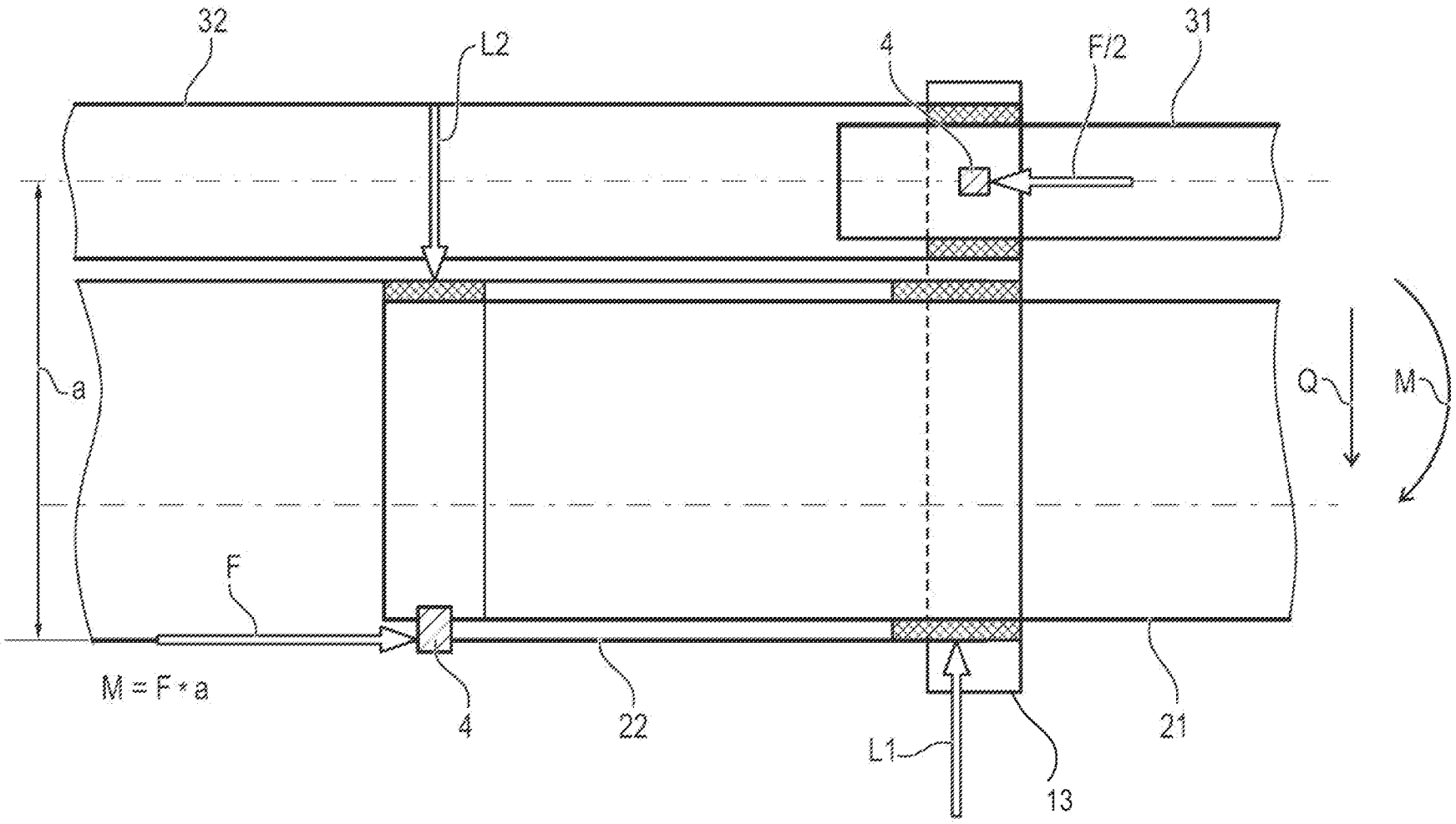
FIG. 2 shows a side view of the first embodiment of the telescopic boom.

Variant 1 is shown in FIG. 2. The bolt connection takes place here in the main telescopic boom at the start of the inner telescopic part to the outer telescopic part. For this purpose, a single bolt 4 can be arranged in the region, in particular in the lower region, of the corresponding main telescopic parts 2. The bolt connection in the additional boom takes place at the front from the outer telescopic part to the inner telescopic part of the additional boom, with two bolts 4 respectively being able to be arranged at the side. The respective outer telescopic parts 22, 32 are shown in the left region of FIGS. 2, 3 and 5 and the inner telescopic parts 21, 31 are shown in the right region. The forces, torques, and distances resulting in the telescopic boom here are shown by arrows and by the reference symbols a, F, L, M, and Q.

Figure 3:
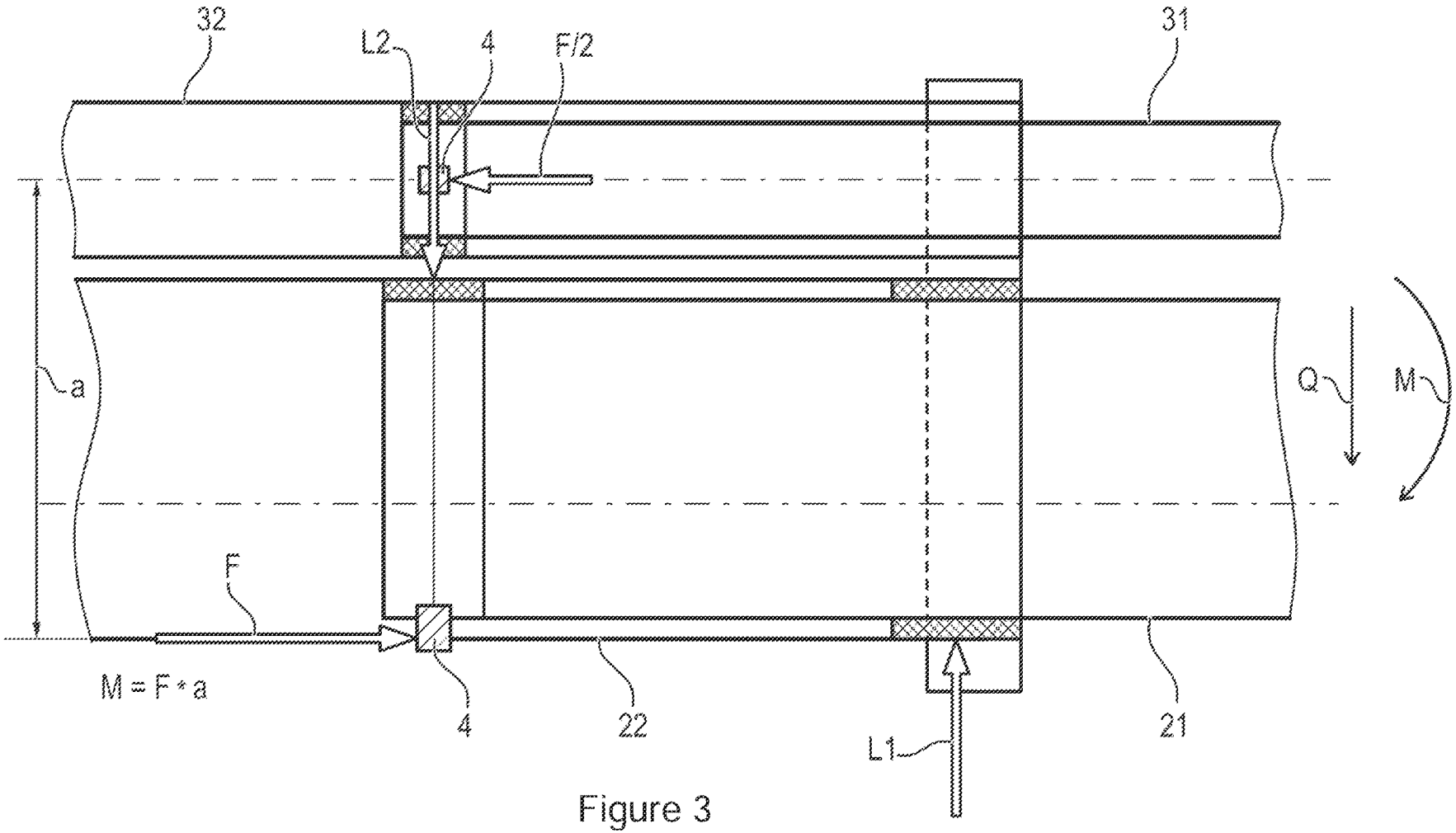
FIG. 3 shows a side view of the first embodiment of the telescopic boom with a first bolt connection variant.

Variant 2 is shown in FIG. 3. The bolt connection takes place in the main telescopic boom at the start of the inner telescopic part to the outer telescopic part. The bolt connection in the additional boom takes place at the rear from the inner telescopic part to the outer telescopic part of the additional boom.

Figure 4:
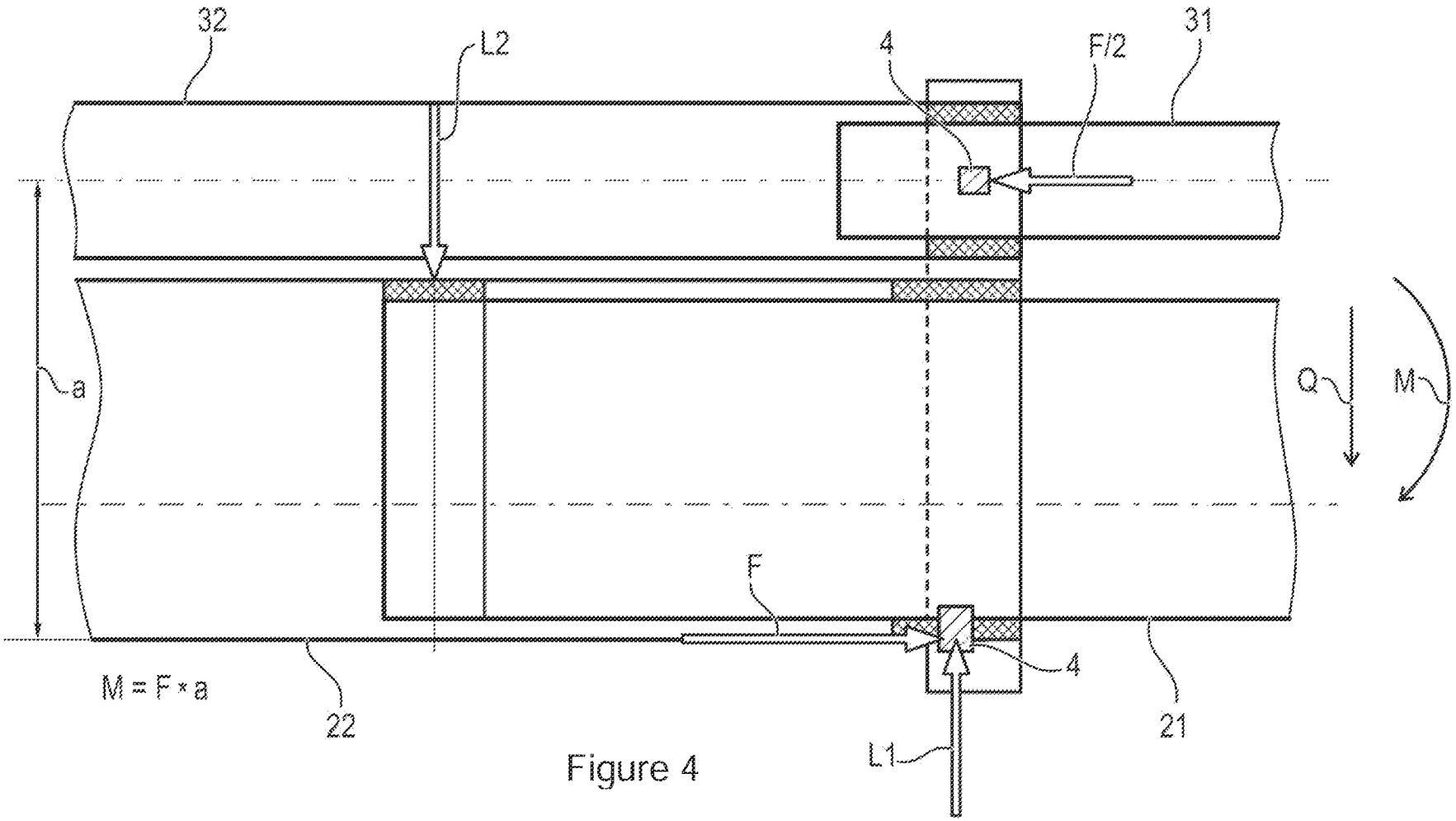
FIG. 4 shows a side view of the first embodiment of the telescopic boom with a further bolt connection variant.

Variant 3 is shown in FIG. 4. The bolt connection takes place in the main telescopic bearing at the front from the outer telescopic part to the inner telescopic part. The bolt connection in the additional boom likewise takes place at the front from the outer telescopic part to the inner telescopic part. Instead as shown, two respective bolting points instead of only one can also be provided in the main telescopic boom parts. In the variants of FIGS. 2 to 4, 1, 2, or more bolts can be used that can in particular be arranged on each side of the telescopic parts 2, 3.

External loads from bending torques (main torque, lateral torque, torsional torque) and forces in the longitudinal direction of the boom 1 are led off in the overlapping region of the telescopic parts 2, 3 by forces in the bolt connection points in the longitudinal direction of the telescopic parts 2, 3. The advantage comprises the bearing loads (L1 and L2) being reduced and thus the overlapping region (clamping length) of two telescopic parts being able to be minimized. This allows larger boom lengths.

Figure 5B:
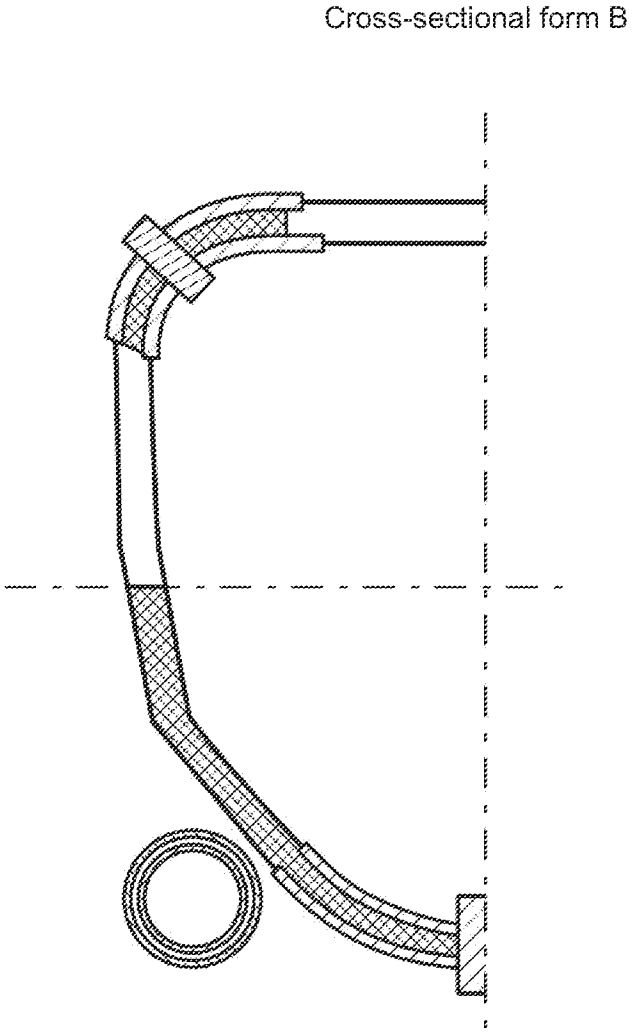
FIGS. 5A, 5B shows different cross-sectional profiles of the telescopic sections.
Figure 5A:
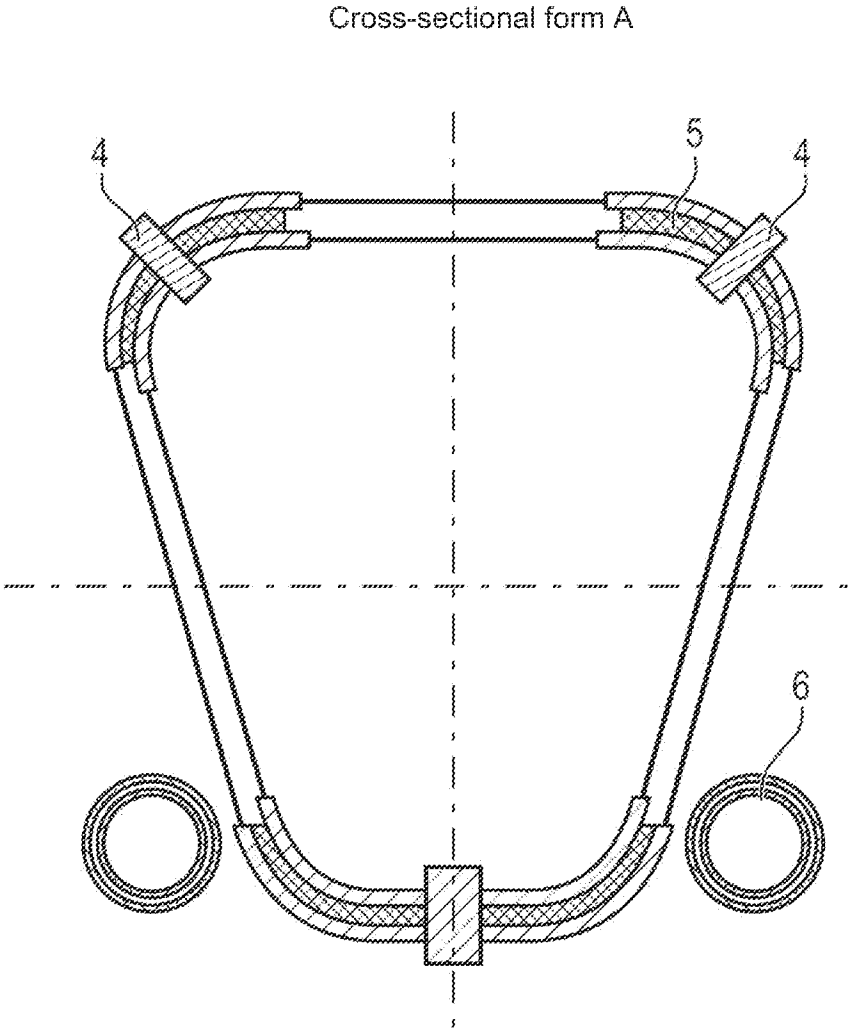

This principle can also be implemented with a telescopic boom comprising the cross-sectional shapes A and B as are shown in FIGS. 5A and 5B. The cross-sections of the individual telescopic profiles can have different sheet metal thicknesses. The bearing elements 5 or sliding bearings 5 can be arranged in corner regions or in rounded regions of the telescopic parts 2, 3. The bolts 4 can likewise be arranged or arrangeable in these regions. In the region of the lower, narrower part of the telescopic boom 1 in which the main boom part 2 is arranged, further devices or structures of the telescopic boom 1 or of the corresponding crane can be arranged adjacent thereto. In the example of FIG. 5A, two luffing rams 6 are shown in a cross-sectional view.

Provision can be made that the telescopic boom section 10 is mechanically boltable to the next larger or adjacent telescopic boom section 10 by at least 2 bolts.

To remove additional transverse torques acting on the telescopic boom 1 in addition to the main torques via the bolting unit, at least three respective bolts can be provided between the telescopic sections.

Figure 6B:
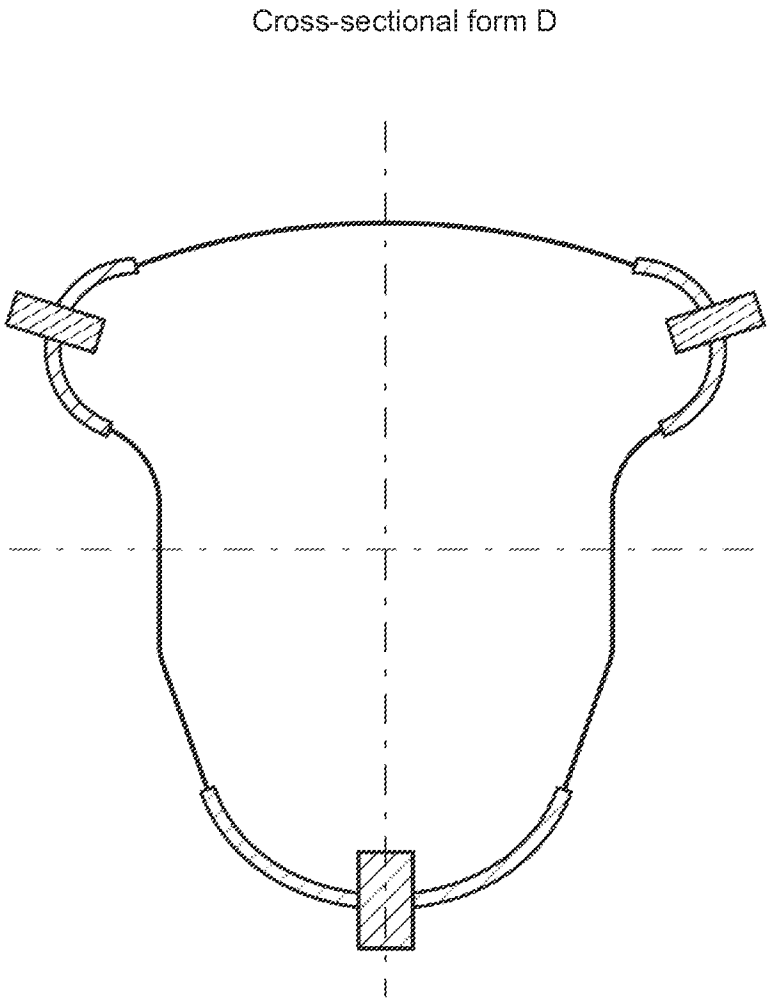
FIGS. 6A, 6B shows different cross-sectional profiles of the telescopic sections.
Figure 6A:
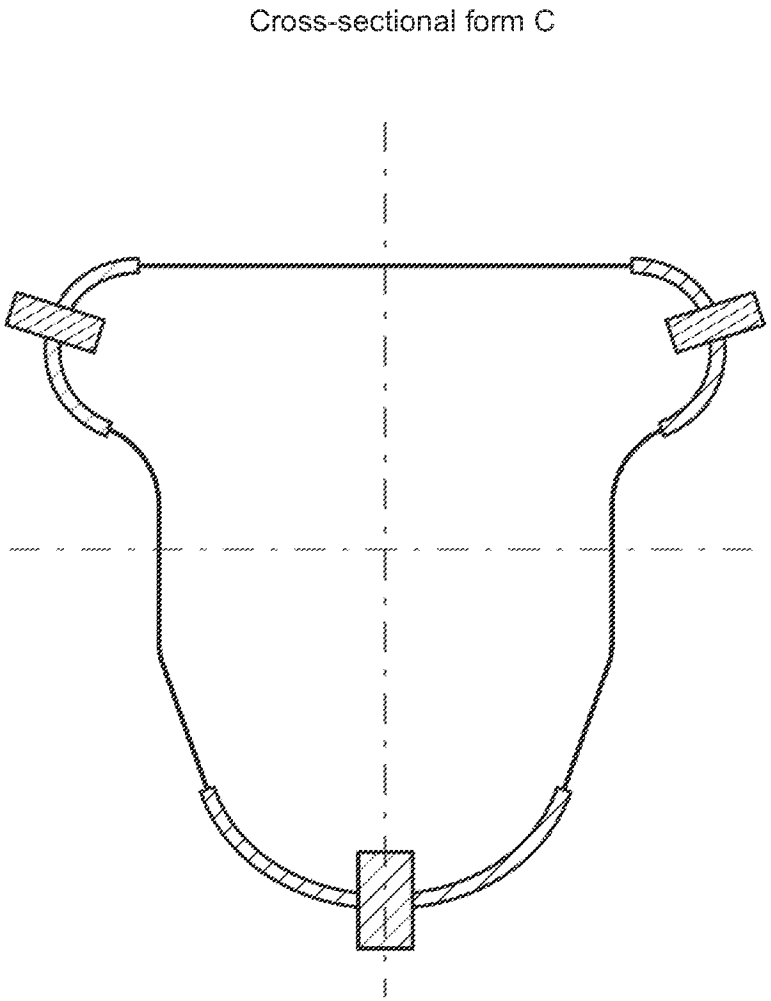

The telescopic boom 1 can comprise further inner telescopic parts 2, 3 having a cross-sectional form "C" or "D" as shown in FIGS. 6A and 6B. The telescopic boom part 2, 3 or its cross-section can consist of or comprise a plurality of individual metal sheets that are edged or bent multiple times and differ in thickness and that are typically connected to one another in the longitudinal boom direction by welding processes (MAG, submerged arc welding, laser beam).

The stability of the profile cross-section is increased by the edged/bent shape of the single metal sheets. The telescopic boom part 2, 3 thereby becomes more resistant to local stability failure (warpage).

The "cross-sectional form D" can have an outwardly curved top chord with respect to the "cross-sectional form C". This shape increases the warp stiffness of the thin-walled top chord under an exertion of pressure, bending pressure, and shear of the top chord. The side chords can be at least portion-wise concavely or inwardly bent or edged. The individual portions or chords can be reinforced and/or connected by reinforced regions in particular provided in the curved regions of the telescopic boom parts 2, 3.

To ensure the guidance of the individual telescopic sections among one another, e.g. during telescoping, guide elements or bearing elements 5, composed e.g. of polyamide, are placed in a targeted manner at the start of the outer telescopic boom part and at the end of the inner telescopic section at the periphery of the cross-section. The number of bearing elements 5 is as desired and is based on demands with respect to the local stability of the overlapping region from the inner telescopic profile section to the outer telescopic boom part.

Figure 7B:
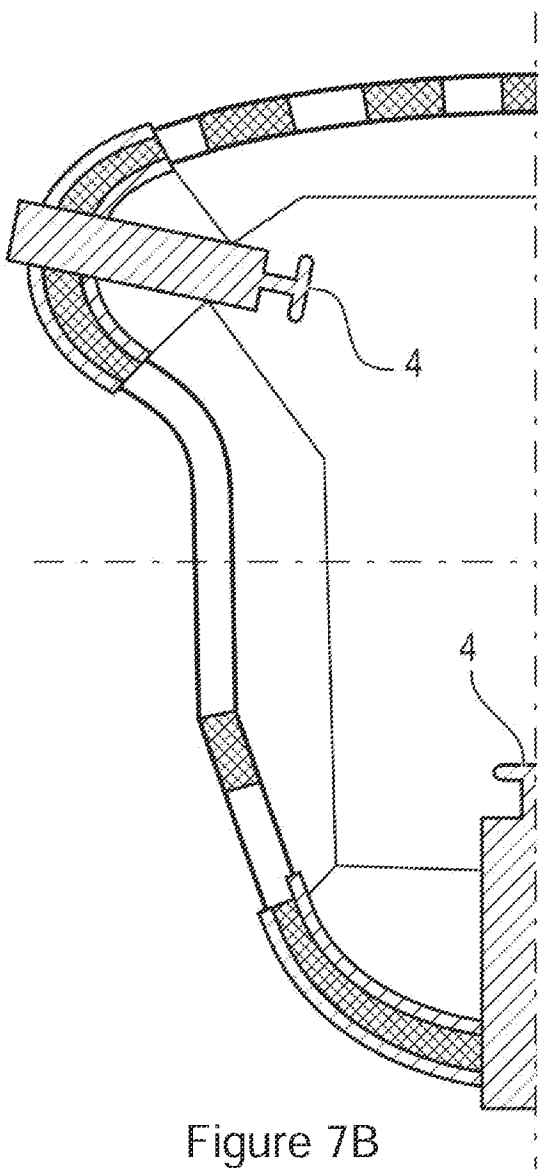
FIGS. 7A, 7B shows different cross-sectional profiles of the telescopic sections.
Figure 7A:
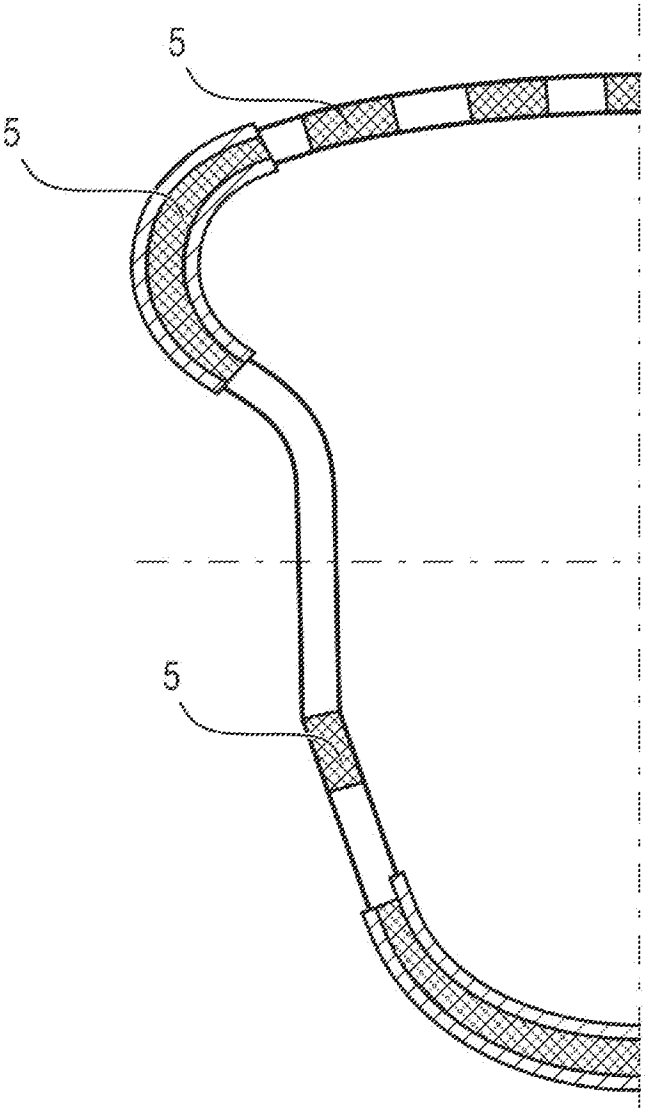

FIGS. 7A and 7B show embodiments in which the bearing elements 5 are arranged distributed portion-wise between the telescopic parts 2, 3. Bolts 4 are further shown that can be arranged in the same regions as the bearing elements 5.

Figure 8:
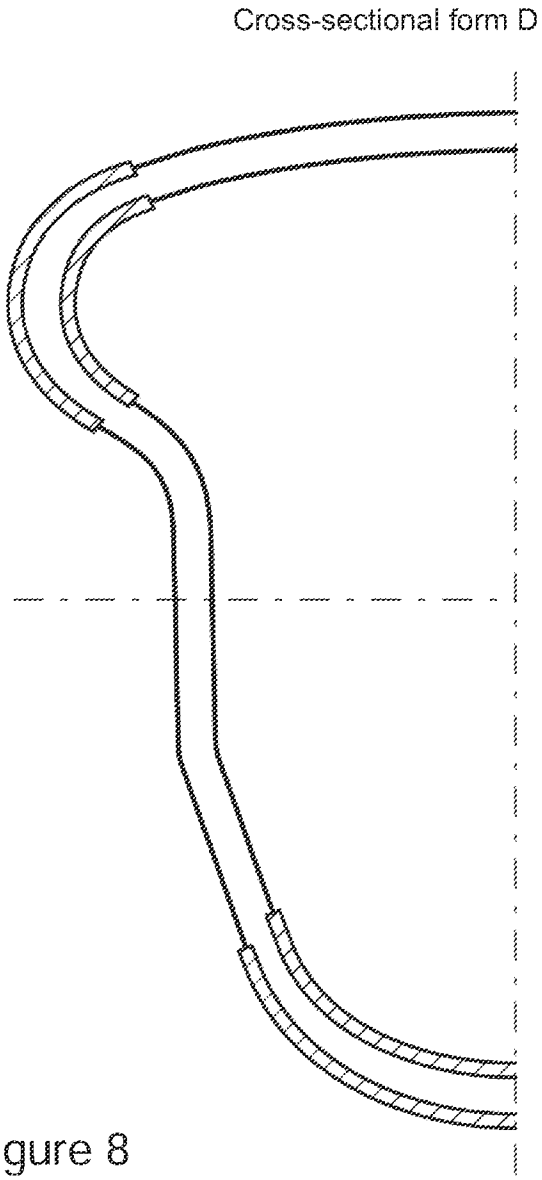
FIG. 8 shows a detailed view of a cross-sectional profile.

FIG. 8 shows an enlarged view of the cross-sectional shape "D", with it being able to be recognized that the telescopic parts 2, 3 can be produced from metal sheets of different thicknesses.

Figure 9:
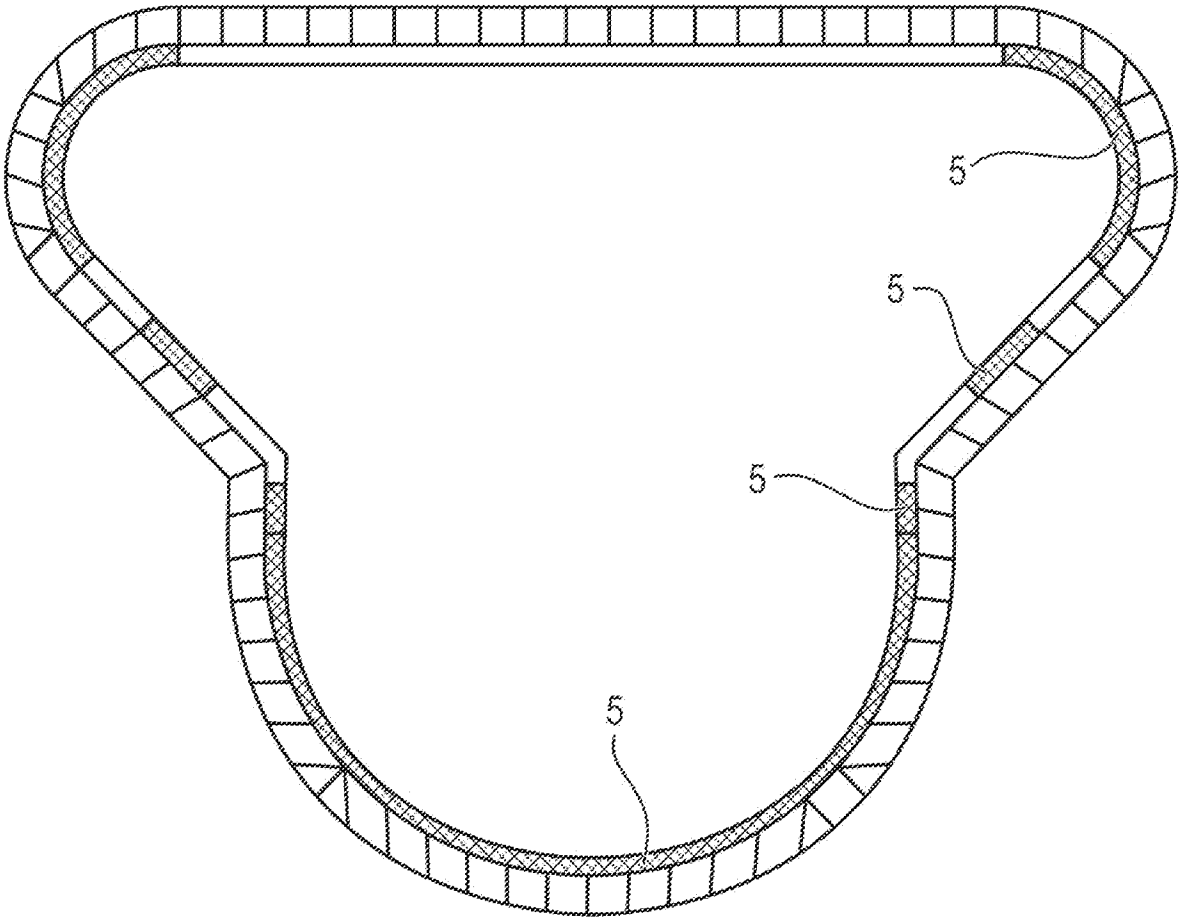
FIG. 9 shows a cross-sectional view of a second embodiment of the telescopic boom.

FIG. 9 shows a cross-section of a second embodiment of the telescopic boom 1, with a single, common hollow space being bounded by the telescopic parts 2, 3. The bearing elements 5 can be arranged at a plurality of points between the individual telescopic sections 10.

Figure 10:
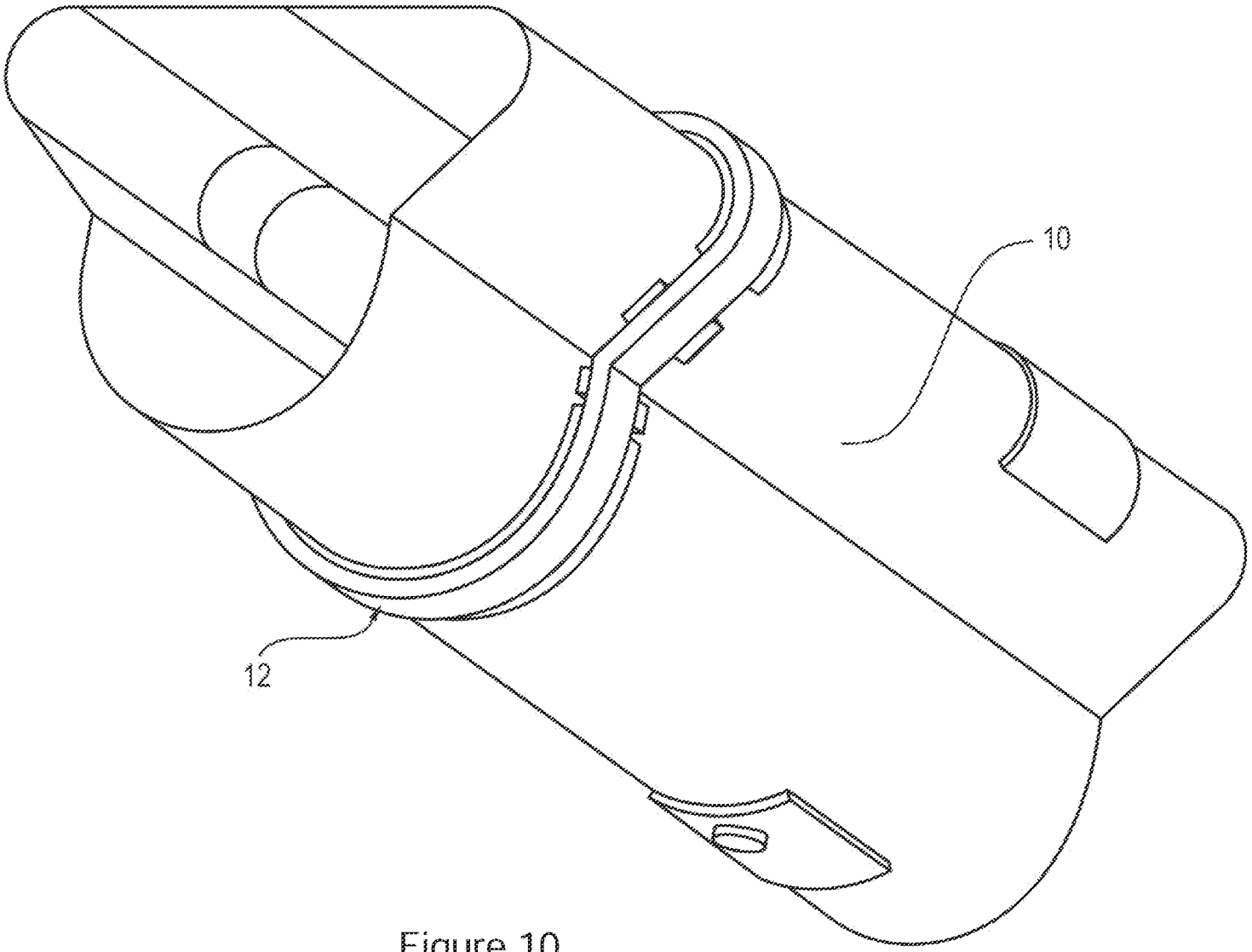
FIG. 10 shows a perspective view of a second embodiment of the telescopic boom.
Figure 11:
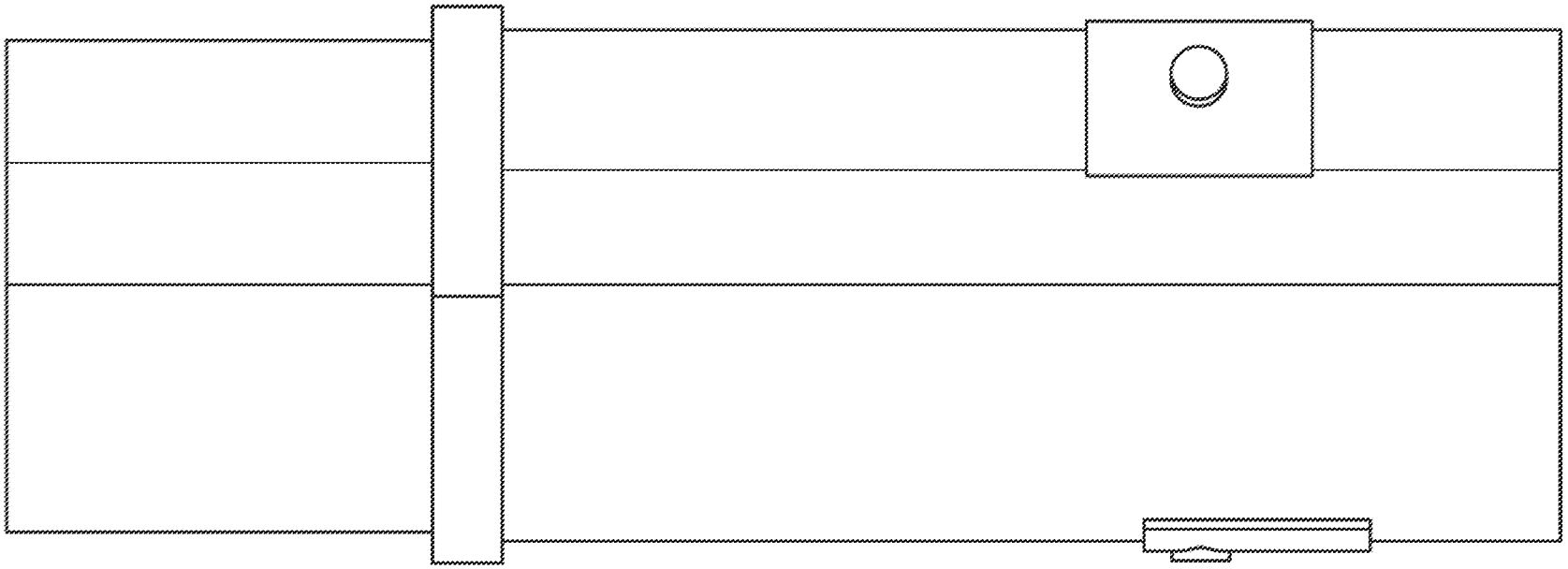
FIG. 11 shows a lateral view of a second embodiment of the telescopic boom.

FIG. 10 shows the second embodiment having a collar reinforcement 12 of an outer profile section 10. The collar reinforcement 12 can make possible a more stable or safer support of the telescopic section 10 supported therein. FIG. 11 shows a corresponding side view.

Figure 12:
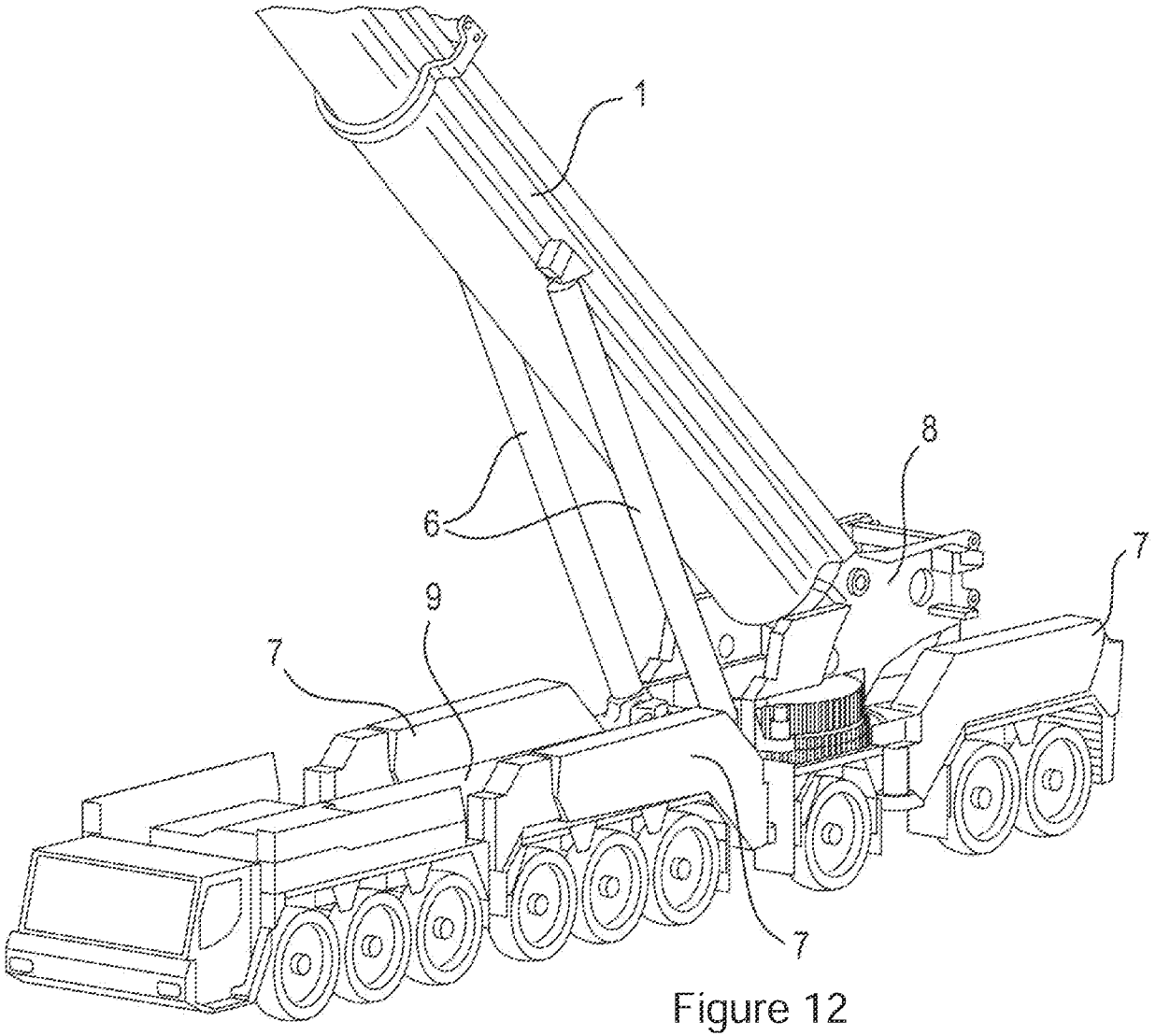
FIG. 12 shows a perspective view of a crane in accordance with the disclosure.
Figure 13:
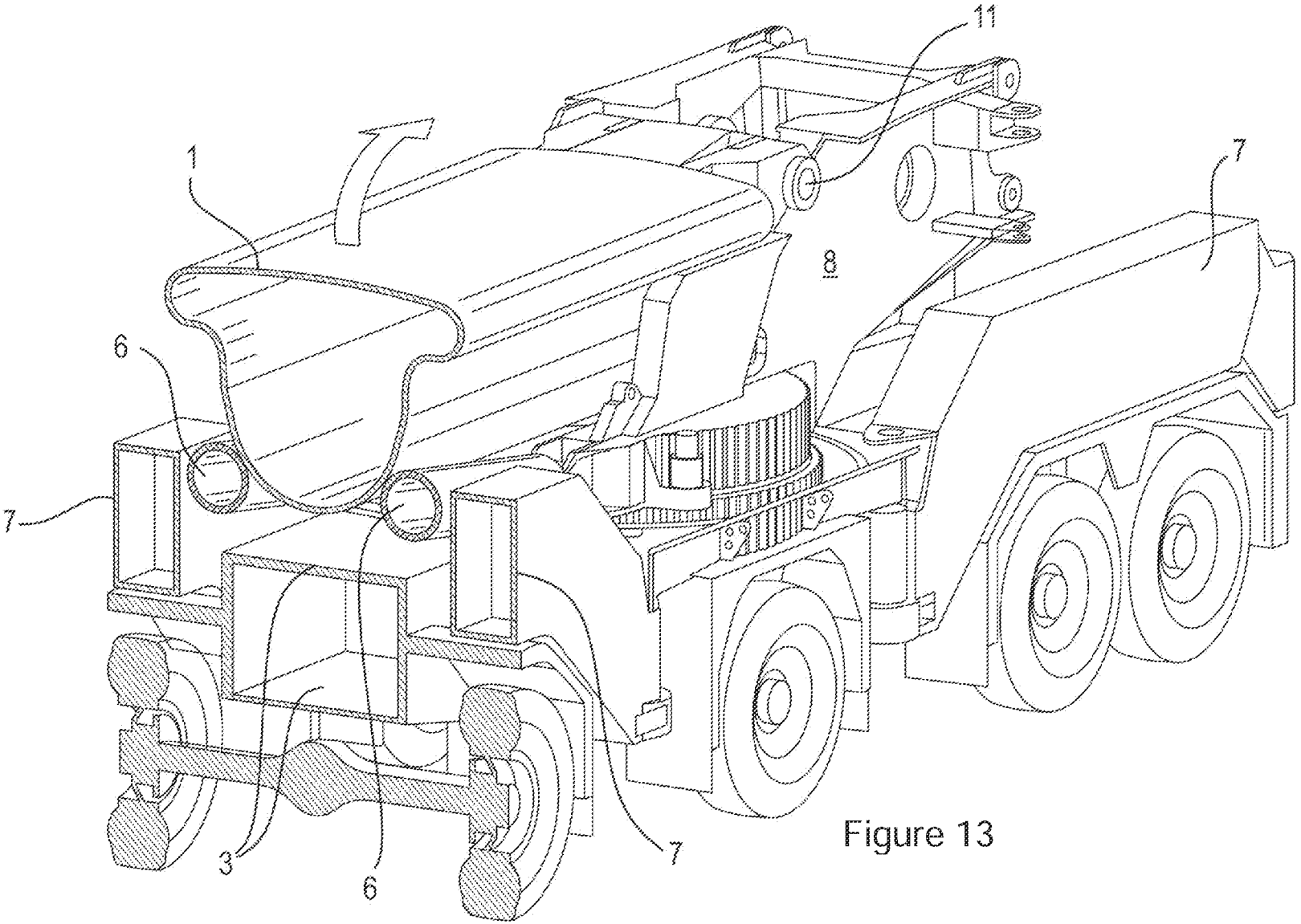
FIG. 13 shows a sectional view of a crane in accordance with the disclosure.
Figure 14:
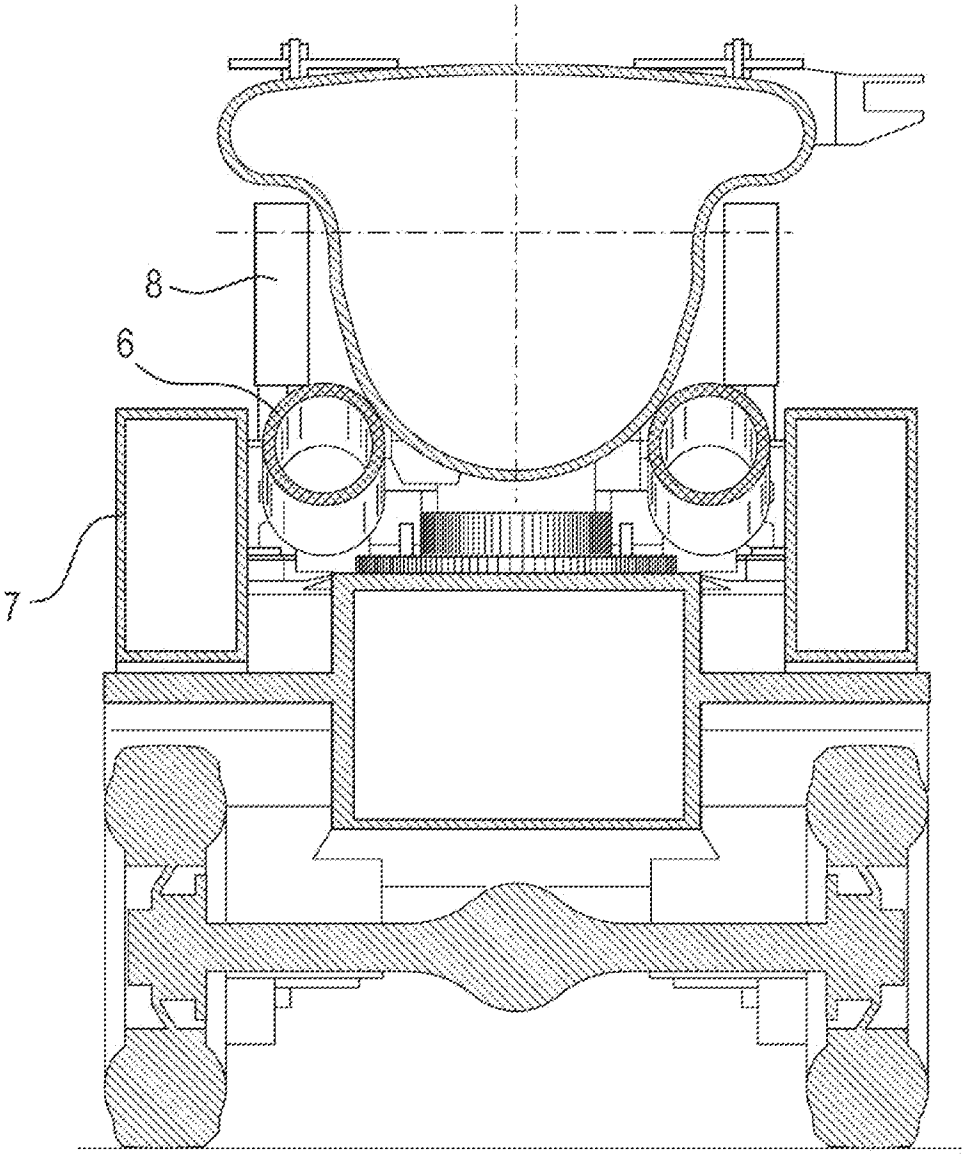
FIG. 14 shows a further sectional view of a crane in accordance with the disclosure.

Reference will be made to FIGS. 12 to 14 in the following. FIG. 12 shows a crane in accordance with the disclosure having a partially luffed-up telescopic boom 1 in a working position. The crane comprises support pillars 7 that can be designed as folding pillars, a slewing platform 8 to which the telescopic boom 1 is bolted, and a vehicle frame 9 or interference contours.

In the shown telescopic boom cross-sectional form, the upper region of the cross-section can be considerably wider than the lower. It is thus possible to better utilize the available construction space at the total crane. In the lower region of the boom cross-section, the boom 1, the luffing rams 6 and the support pillars have to be arranged within the maximum permitted vehicle width. The lower part of the boom cross-section therefore has a smaller width. The boom 1 furthermore has to be adjustable in an angular range from 0° to almost 90° in crane operation. The boom 1 is bolted in the slewing platform 8 for this purpose and is rotatably supported in the luffing plane. No collision with the slewing platform 8 may, however, occur in the luffing region of the boom from 0° to approximately 90°. Since the boom 1 has to partially dip into the structural steelwork of the slewing platform 8 due to the construction, the boom cross-section has to taper in the lower region.

To achieve a section modulus or second moment of the boom cross-section that is as high as possible without compromising the conditions (with respect to the luffing range 0° to approximately 90°) required from a construction aspect, the upper region of the boom cross-section was configured as considerably wider than the lower region. The available construction space of the total crane is thus ideally used. The telescopic boom 1 thereby has a high stiffness, in particular in a lateral direction. Payload increases are thereby possible with large demanded lifting heights.

The telescopic boom in accordance with the disclosure can thus have a mushroom-shaped telescopic boom cross-sectional form in section. This in particular has advantages in the positioning on the superstructure of a mobile crane since the space here can be ideally used. The mushroom shape has the advantage that the narrow part is positioned in the frame provided on the superstructure while the projecting, mushroom-shaped upper part can overhang here.

In accordance with the disclosure, an edged design can furthermore be used instead of a bend design to produce the radii of the telescopic boom 1 or of its telescopic sections 10.

The pivot axis 11 of the telescopic boom is furthermore shown in FIG. 13 that can comprise the bolt connection of the telescopic boom 1 to the slewing platform 8.

The double arrow here shows the luffing direction of the boom.

The invention claimed is:

1. A telescopic boom for a crane, comprising:

telescopic sections each comprising:

at least one main telescopic part and at least one additional telescopic part arranged above one another, the main telescopic part and the additional telescopic part bound one common hollow space, and the additional telescopic part is wider than the main telescopic part, wherein a portion of the telescopic sections has a mushroom-shaped cross-section, and wherein a portion of the telescopic sections that is central in a vertical direction is concave when viewed from outside.

2. The telescopic boom in accordance with claim 1, wherein the telescopic sections are configured to bolt an inner main telescopic part to an outer main telescopic part from inside and to bolt an inner additional telescopic part to an outer additional telescopic part from outside.

3. The telescopic boom in accordance with claim 2, wherein bearing elements are provided between the telescopic sections.

4. The telescopic boom in accordance with claim 2, wherein an outermost main telescopic part and an outermost additional telescopic part are connected to one another with shear rigidity at their ends.

5. The telescopic boom in accordance with claim 2, wherein the main telescopic part is connected to the respective additional telescopic part with shear rigidity at one of their ends.

6. The telescopic boom in accordance with claim 1, wherein the telescopic sections are configured to bolt an inner main telescopic part to an outer main telescopic part from inside and to bolt an inner additional telescopic part to an outer additional telescopic part from the inside.

7. The telescopic boom in accordance with claim 6, wherein an outermost main telescopic part and an outermost additional telescopic part are connected to one another with shear rigidity at their ends.

8. The telescopic boom in accordance with claim 6, wherein the main telescopic part is connected to the respective additional telescopic part with shear rigidity at one of their ends.

9. The telescopic boom in accordance with claim 1, wherein the telescopic sections are configured to bolt an inner main telescopic part to an outer main telescopic part from outside and to bolt an inner additional telescopic part to an outer additional telescopic part from the outside.

10. The telescopic boom in accordance with claim 9, wherein an outermost main telescopic part and an outermost additional telescopic part are connected to one another with shear rigidity at their ends.

11. The telescopic boom in accordance with claim 9, wherein the main telescopic part is connected to the respective additional telescopic part with shear rigidity at one of their ends.

12. The telescopic boom in accordance with claim 1, wherein an outermost main telescopic part and an outermost additional telescopic part are connected to one another with shear rigidity at their ends.

13. The telescopic boom in accordance with claim 1, wherein the main telescopic part is connected to the respective additional telescopic part with shear rigidity at one of their ends.

14. The telescopic boom in accordance with claim 1, wherein bearing elements are provided between the telescopic sections.

15. The telescopic boom in accordance with claim 1, wherein a portion of the telescopic sections that is central in a vertical direction extends, when viewed in cross-section, at least portion-wise in parallel with an upper and/or a lower portion of the telescopic sections.

16. A crane having a telescopic boom, the telescopic boom comprising:

telescopic sections of the telescopic boom each comprising:

at least one main telescopic part and at least one additional telescopic part arranged above one another, the main telescopic part and the additional telescopic part bound one common hollow space, and the additional telescopic part is wider than the main telescopic part; and at least one device arranged to a side of the main telescopic part, wherein a portion of the telescopic sections has a mushroom-shaped cross-section, and wherein a portion of the telescopic sections that is central in a vertical direction is concave when viewed from outside.

17. The crane in accordance with claim 16, wherein the at least one device is one or more of support pillars, load-bearing structural steelwork of the slewing platform, or luffing rams.

18. The crane in accordance with claim 16, wherein the mushroom-shaped cross-section is formed by the concave portions forming a transition between a lower portion and an upper portion, which is wider than the lower portion.

* * * * *